US005471695A

United States Patent [19]

Aiyar

[11] Patent Number: 5,471,695

[45] Date of Patent: Dec. 5, 1995

[54] MOTORIZED BRUSH

[76] Inventor: Sanjay Aiyar, 18671 E. Woodwind La., Anaheim, Calif. 92807

[21] Appl. No.: 298,606

[22] Filed: Aug. 31, 1994

[51] Int. Cl.[6] ..... A46B 13/02

[52] U.S. Cl. ..... 15/22.1; 601/72

[58] Field of Search ..... 15/22.1, 22.2, 15/22.4, 97.1; 601/70, 72, 137, 138; 310/81

[56] References Cited

U.S. PATENT DOCUMENTS

| | | | |
|---|---|---|---|
| 3,196,299 | 7/1965 | Kott | 15/22.1 |
| 3,358,309 | 12/1967 | Richardson | 15/22.1 |
| 3,466,689 | 9/1969 | Aurelio et al. | 15/22.1 |
| 3,685,080 | 8/1972 | Hubner | 15/22.1 |
| 3,775,800 | 12/1973 | Veneziani . | |
| 3,932,908 | 1/1976 | Bitgood et al. . | |
| 3,982,297 | 9/1976 | Belluomo . | |
| 4,295,240 | 10/1981 | Lex | 15/22.1 |
| 4,476,602 | 10/1984 | Hurn et al. . | |
| 4,574,419 | 3/1986 | Lex | 15/22.1 |
| 4,669,452 | 6/1987 | Osawa . | |
| 4,799,280 | 1/1989 | Lee . | |
| 4,841,954 | 6/1989 | Kalsi . | |
| 4,885,815 | 12/1989 | Smith . | |
| 4,920,466 | 4/1990 | Liu . | |
| 5,016,616 | 5/1991 | Hu . | |
| 5,067,480 | 11/1991 | Woog et al. . | |

FOREIGN PATENT DOCUMENTS

| | | | |
|---|---|---|---|
| 1191080 | 11/1985 | U.S.S.R. | 601/70 |

*Primary Examiner*—Edward L. Roberts, Jr.
*Attorney, Agent, or Firm*—Knobbe, Martens, Olson & Bear

[57] ABSTRACT

A motorized brush imparts vibrational motion to a scrubbing brush head. The brush includes a water-tight housing, in which a small electric motor is mounted. The motor includes an eccentric weight mounted to its drive shaft. In use, the motor is energized, causing the eccentric weight to be rotated. The eccentric weight vibrates the brush head without rotating it. This vibrational motion provides an effective scrubbing action without the necessity for complex sealing mechanisms connecting the brush head to the motor shaft.

13 Claims, 6 Drawing Sheets

MOTORIZED BRUSH

FIELD OF THE INVENTION

The present invention relates to hand-held electric-powered scrubbing devices for use in wet or damp areas.

BACKGROUND OF THE INVENTION

There are many ordinary activities which require the use of a scrubbing action. Scrubbing is used not only to clean and polish, but also to remove rust and to sand. Consequently, many scrubbing devices have been created to assist in this commonplace activity.

Most mechanically-assisted scrubbing devices generally apply rotational motion to a brush or attachment about its central axis to achieve the desired scrubbing action. The rotational motion may be applied directly, by connecting the brush to the shaft of a motor, or indirectly, by interposing gears between the brush and motor. In either case, however, the brush or attachment which does the scrubbing fully rotates about its central axis.

Rotation of the scrubbing brush causes several problems. Firstly, for use in wet areas, a seal is required where the drive shaft exits the housing of the scrubber. Such a seal is usually complicated and is prone to failure after extended use. In addition, the rotation of the scrubbing brush at high speed tends to splash the cleaning fluid used in the scrubbing operation. Furthermore, rotation of the brush requires a strong motor to prevent stalling when the brush is pushed down hard against the cleaning surface. The employment of a strong motor with the brush results in the imposition of added requirements for dispersing the additional heat generated by the strong motor. A larger power supply may also be required.

Devices using reciprocating motion are also possible as well. However, many of the problems mentioned above are also present for such devices, including the problem of splashing the cleaning fluid. Consequently, a need exists for a motorized cleaning brush which avoids the splashing, high power requirements, and sealing difficulties present in prior-art rotating or reciprocating motorized brushes.

SUMMARY OF THE INVENTION

In accordance with the present invention, a motorized cleaning brush is provided which includes an electric motor having a housing and a drive shaft. The drive shaft is connected to an eccentric weight and rotates the weight in response to electric power supplied to the motor. The weight may be connected directly to the drive shaft or may be coupled to the drive shaft via a flexible shaft. A brush head is coupled to the housing, and the motor and weight are enclosed in a water-tight compartment. The motor and the eccentric weight cooperate to provide vibrational motion to the brush head without rotating it. Thus, complicated seals are not required. According to another aspect of the present invention, the motorized brush head is removably secured to the water-tight compartment.

According to yet another aspect of the present invention, the brush further includes a spring mounted to the water-tight compartment. The spring connects the motor to the water-tight compartment on the end of the motor opposite the drive shaft. The spring reduces the level of vibration transmitted from the eccentric weight to the water-tight compartment.

According to yet another aspect of the present invention, a motorized scrubbing appliance is provided which includes a water-tight housing having a handle, an electric motor having both proximal and distal ends, and a drive shaft mounted to the proximal end of the motor. A spring is mounted to the distal end of the motor and to the housing to support the motor. An eccentric weight is mounted to the end of the drive shaft of the electric motor. The spring reduces the level of vibration transmitted from the motor to the handle of the housing. A water-tight cover encloses both the motor and the eccentric weight, and a brush head is attached to the water-tight cover. In operation, the motor and the eccentric weight cooperate to vibrate the brush head without rotating the brush head when the motor is supplied with electric power. The appliance may also include a switch connected to the motor to turn it on and off.

According to still another aspect of the present invention, a motorized scrubbing device includes a brush head, a housing connected thereto, and a motor mounted within the housing. The brush further includes an eccentric weight coupled to the motor for imparting vibrational motion to the brush head when the motor is supplied with electric power. A water-tight handle contains the housing. The housing is thus isolated from fluid in contact with the brush head. A spring is mounted to the motor to secure the motor to the handle.

In a further embodiment, a motorized brush for scrubbing a surface comprises a brush head which connects to a housing. A motor is secured within the housing, and a flexible shaft is connected to the motor so that the flexible shaft is rotatable by the motor. An eccentric weight is in coupled with the flexible shaft so that the flexible shaft can impart rotational motion to the eccentric weight. The eccentric weight is of such a dimension and weight to cause the flexible shaft, together with the eccentric weight to trace an epicircular path and, thereby, to cause the brush head to vibrate.

The brush of the present invention solves the problems encountered in the prior art discussed above and is easy and inexpensive to manufacture. The brush of the present invention advantageously requires few moving parts, and the types of parts used are simple and inexpensive. There is no requirement for intricately fine-tuning or balancing the parts, and complex placement and interaction of the parts is avoided. The brush of the present invention advantageously provides the desired scrubbing action for difficult cleaning tasks while significantly reducing the splashing of cleaning liquid.

DETAILED DESCRIPTION OF THE PREFERRED EMBODIMENTS

Figure 1:
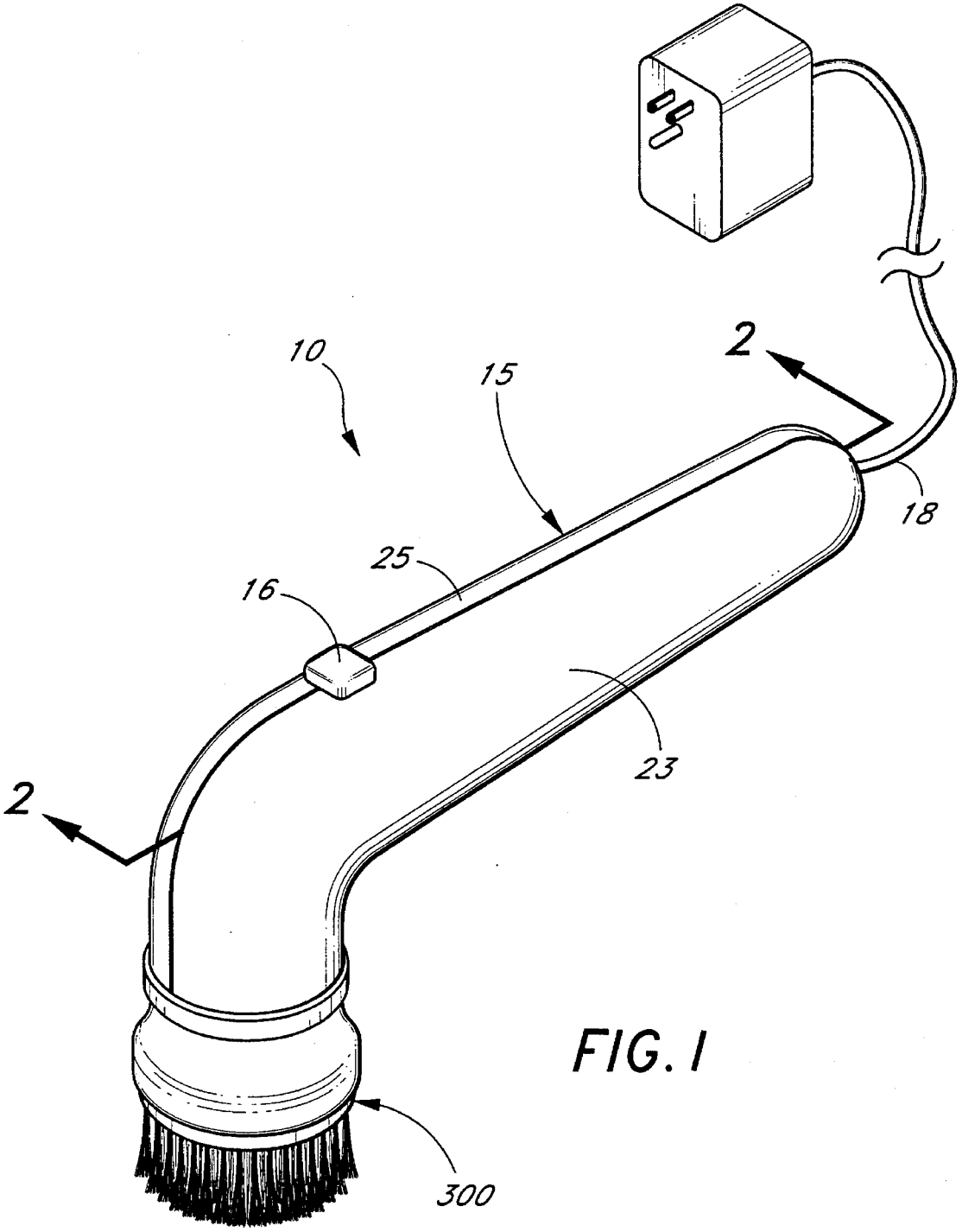
FIG. 1 is a perspective view of a motorized brush of the present invention.

Referring to the drawings, FIG. 1 illustrates a motorized brush generally at 10. A housing 15 provides a mounting for all of the components of the brush. The housing 15 is formed from two halves 23, 25, which, when mated, define a water-tight hollow space 27 that forms the enclosure for parts contained therein. An opening 12 (FIG. 2) in the housing 15 forms a liquid tight entrance for a pair of wires 18 to power the brush 10 from a conventional low-voltage power source (e.g., an AC/DC adaptor, not shown). Alternatively, the wires 18 may be used as a source of power to recharge a battery 13 (FIG. 2) that may be secured in place between the two halves 23, 25.

Figure 2:
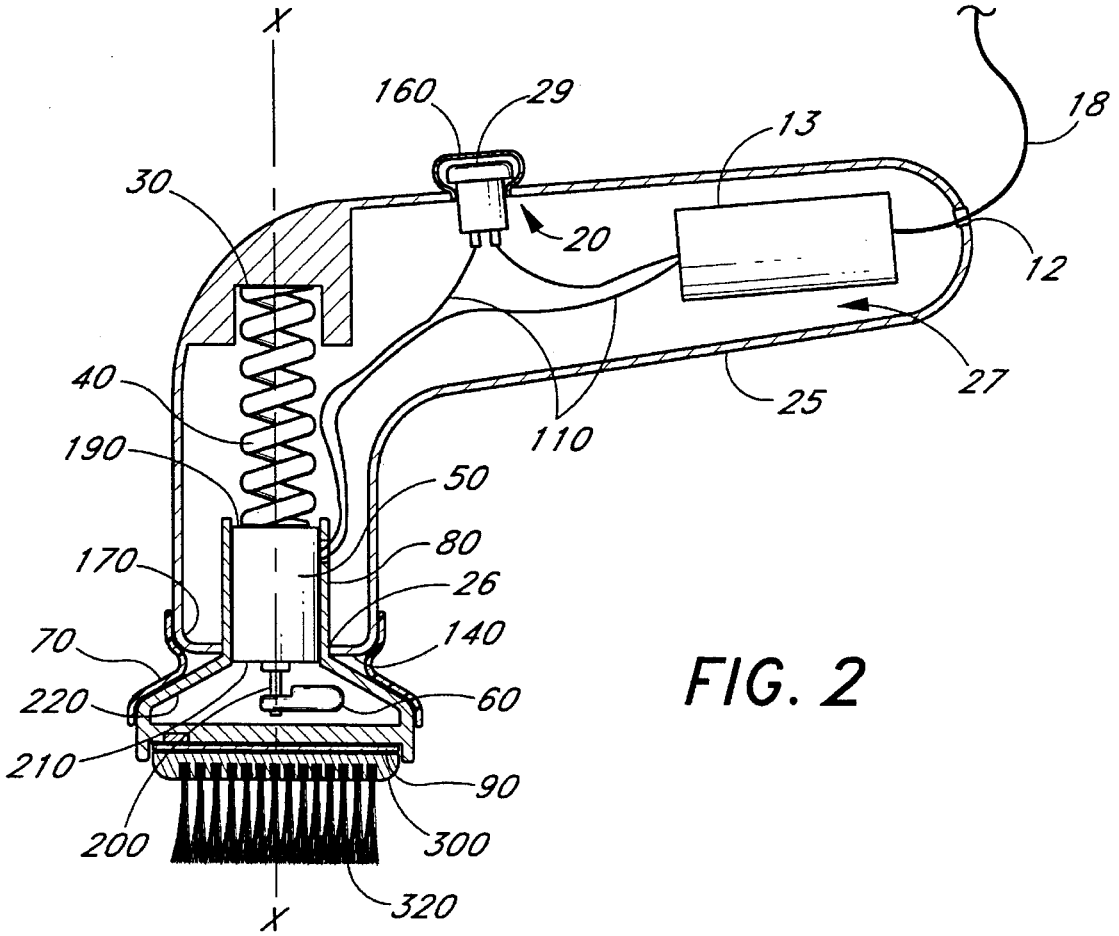
FIG. 2 is a partial cross-sectional view of the brush taken along the line 2—2 in FIG. 1 wherein the brush housing is opened to reveal the internal components of the brush, and the motor and brush head are shown in cross-section.
Figure 6:
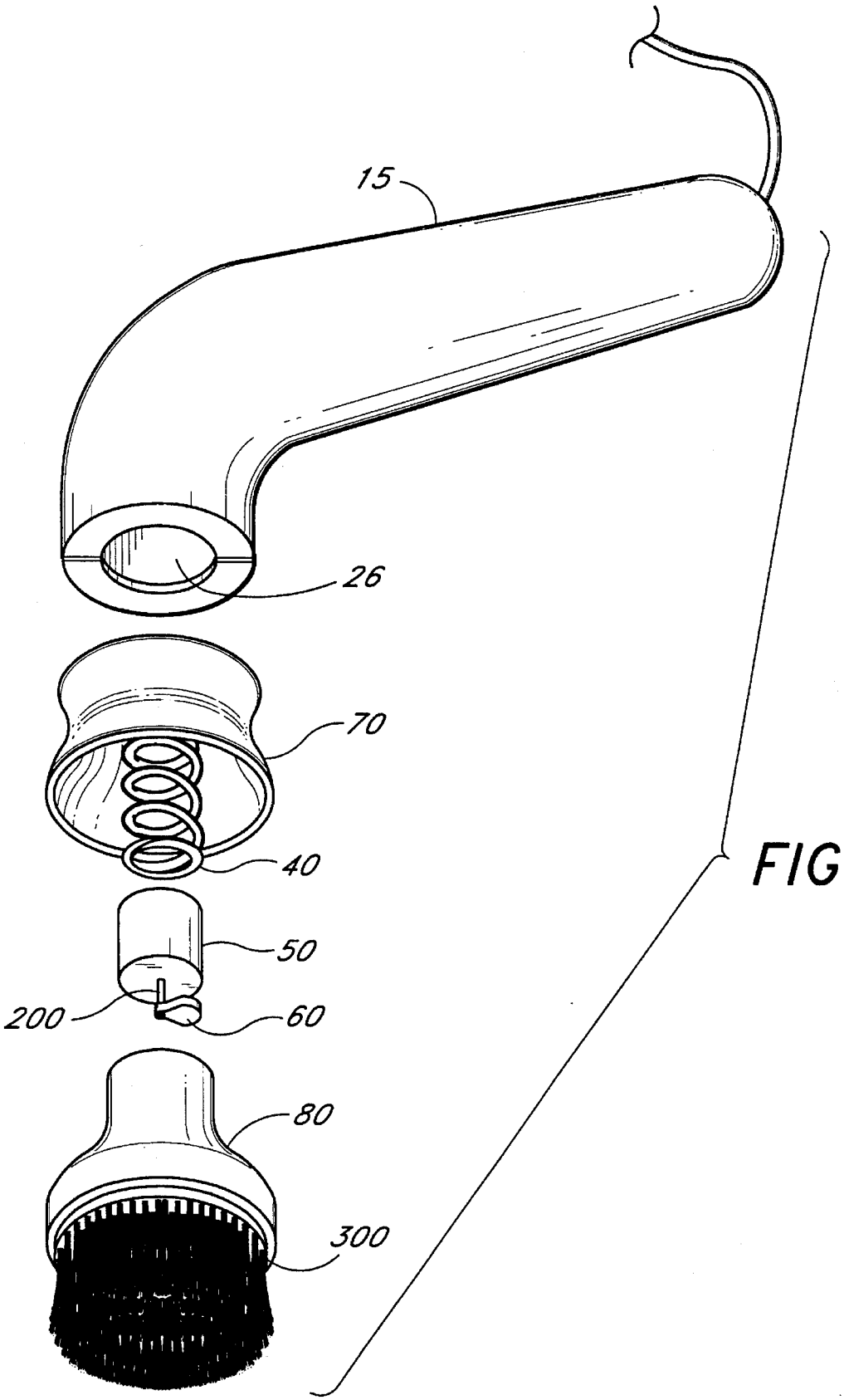
FIG. 6 is an exploded assembly view which shows the main structural components of the motorized brush of the present invention in perspective.

As shown in FIG. 2, an actuator switch 29 is mounted in another opening 20 of the housing within a water-tight boot 160. The switch 29 is situated so that it is secured when the two halves 23, 25 of the housing 15 are joined together. The boot 160 surrounds the switch 29 externally and forms a liquid tight seal around the edges of the opening 20 between the two halves 23, 25 of the housing 15. A motor cover 80 is fitted into the lower portion of the housing 15 through an opening 26. The insertion of the motor cover 80 through the opening 26 is shown more clearly in the exploded perspective view of FIG. 6. The motor cover 80 contains a motor 50. It should be understood, of course, that the motor cover 80 could be included as an integral part of the housing 15. The electric motor 50 is preferably a Mabuchi motor RS-360-SH-14280 running at 12 volts. Alternatively, a Sun Motor Manufactory Limited Sun 363-J operating at 12 volts may be employed. The motor 50 is mounted in the cover 80 and has distal and proximal ends 190 and 210. The proximal end 210 of the motor 50 extends outwardly from a lower edge 140 of the housing 15.

The motor 50 imparts rotational motion to an eccentric weight 60 mounted, preferably by press fitting, to a shaft 200. The shaft 200 extends from the proximal end 210 of the motor 50. The eccentric weight 60 has a weight of approximately ½ ounce in one preferred embodiment, and is preferably made of cast iron. A pair of internal wires 110 provides the motor 50 with electric power from the battery 13 or from an external source. The electric path provided by one of the wires 110 is selectively interruptible by the switch 29 to turn the motor 50 on and off.

A gasket 70 made of a suitable flexible material surrounds the motor cover 80 and a proximal part 170 of the housing 15. The gasket 70 covers the lower edge 140 of the housing 15, thereby making the housing 15 liquid tight. The gasket 70 is fixedly attached to the housing 15 at the proximal part 170 and to the motor cover 80 at location 220 so that there is no relative motion between the part of the gasket 70 contacting the housing 15 and the housing itself.

FIG. 2 shows a spring 40 located inside the housing 15 with one end of the spring 40 fixedly attached to the housing 15 at location 30 and the other end of the spring 40 fixedly attached to the distal end 190 of the motor 50. The spring 40 and the motor shaft 200 preferably share the same central axis X—X. The spring 40 secures the motor 50 to the housing 15 and also advantageously dampens the vibrations transmitted between the motor 50 and the housing 15. Furthermore, the spring 40 acts to isolate the motor 50 and the eccentric weight 60 from the housing 15 so that the motor 50 does not have to move rigidly with the housing 15.

The exposed outside portion of the motor cover 80 forms a complete liquid tight seal around the motor 50 and the weight 60. Thus, the motor cover 80 and the rest of the elements enclosed within the housing 15 are completely impervious to water or other liquids. A brush head 300 or other scrubbing accessory is mounted to the motorized scrubber brush 10 at an attachment site 90.

Figure 3:
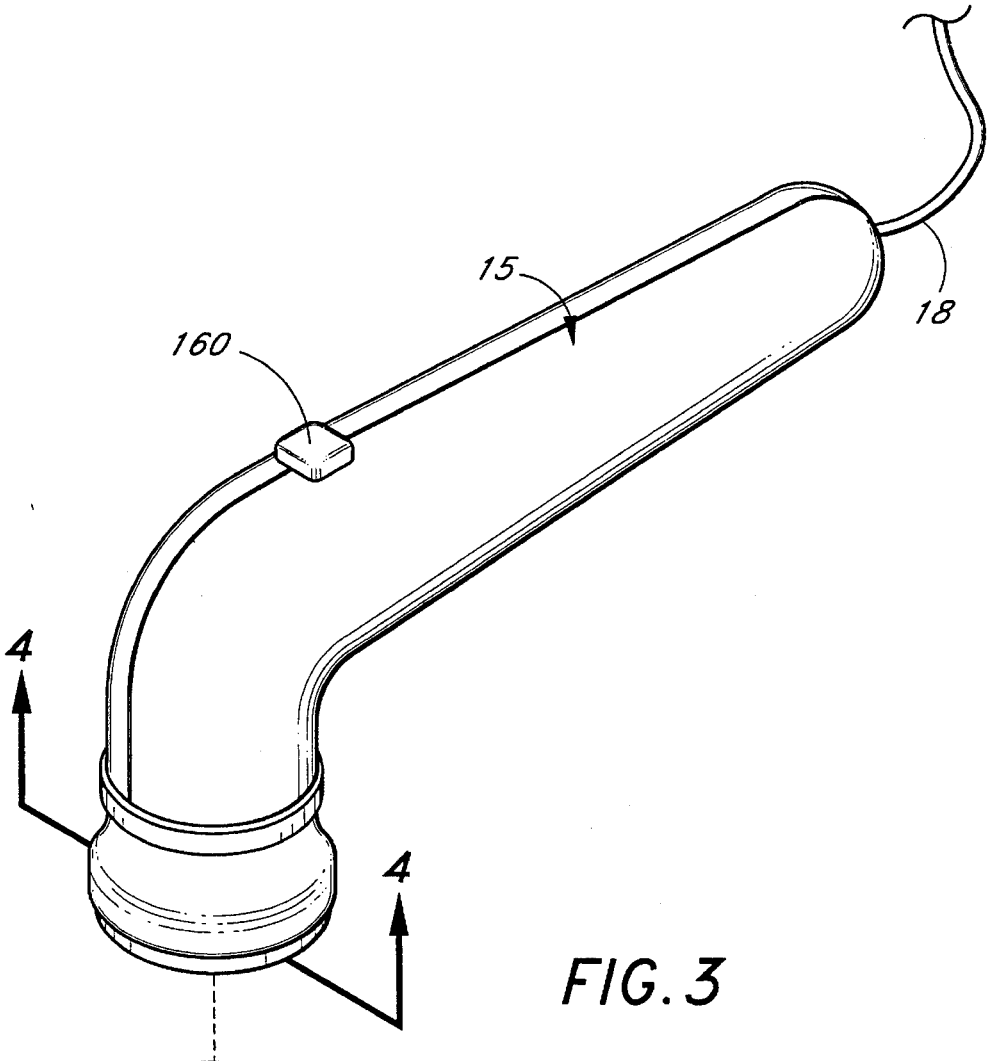
FIG. 3 is a view of the embodiment illustrated in FIG. 1 illustrating the attachment of the brush head to the housing.
Figure 4:
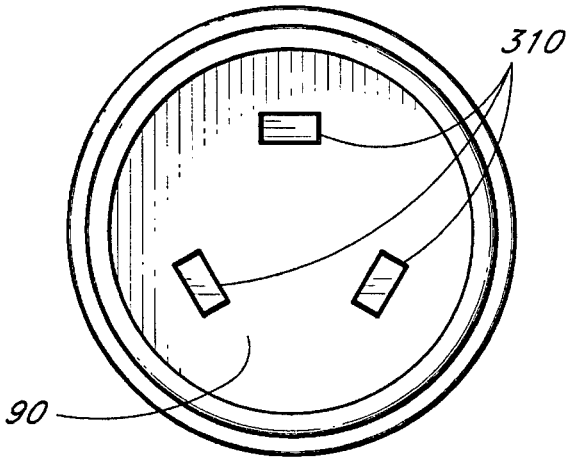
FIG. 4 is a bottom view of the housing to which the brush head is mounted taken along the lines 4—4 in FIG. 3.

As depicted in FIGS. 3 and 4, the brush head 300 includes a ferro-magnetic base area 305 and is mounted to the attachment site 90. The attachment site 90 includes a plurality of magnets 310 which are preferably formed from a neodymium alloy. The brush head 300 is attached to the attachment site 90 by simply placing it in contact with the magnets 310. The brush head 300 is removed by simply pulling on bristles 320 of the brush head 300 to disengage the magnets 310 on the attachment site 90 from the base 305 of the brush head 300, as shown in FIGS. 3 and 4.

When power is supplied to the motor 50, either from the battery 13 or from an external power source, the shaft 200 rotates, which causes the eccentric weight 60 to rotate with the shaft 200. When rotating, the eccentric weight 60 tends to pull the shaft 200 to the side that the weight 60 is on due to the centrifugal force that is caused by the rotation of the weight 60. In this manner, the shaft 200 is caused to rotate in an epicircular pattern.

Figure 5:
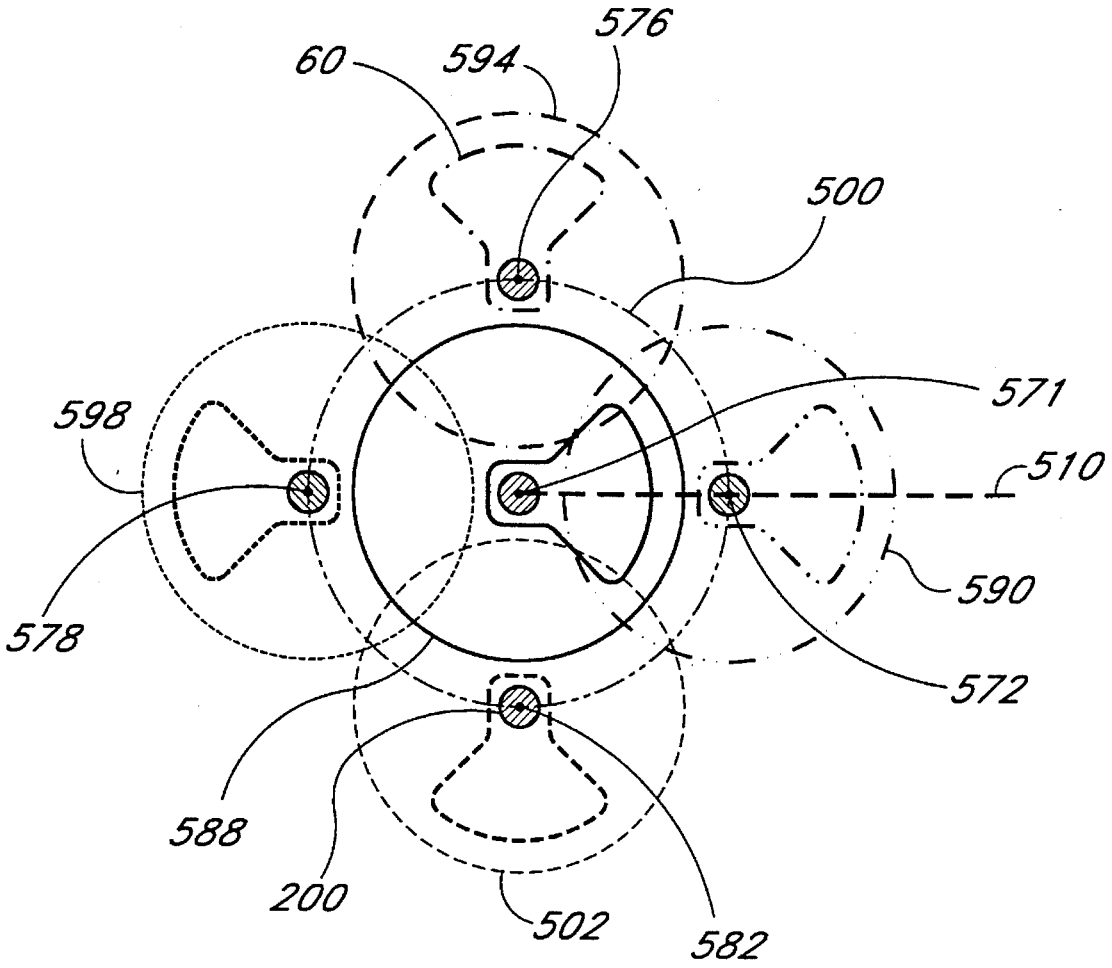
FIG. 5 is a plan schematic view of the path traveled by the scrubbing brush head.

As shown in FIG. 5, the shaft 200 describes an epicircular motion when the shaft 200 traverses a circle 500 caused by the centrifugal force of the eccentric weight 60, in addition to rotating in a circular motion about its own axis. In a resting state, the shaft 200 is at location 571. However, when the motor 50 causes the weight 60 to spin, the shaft 200 is displaced from the central resting position 571 to another position 572. The displacement of the shaft 200 from the rest position 571 is exaggerated in FIG. 5 for clarity of illustration. After 90 degrees of rotation, the shaft 200 is displaced to a position 576. This outward displacement from the center position 571 continues as the shaft 200 moves through 180 degrees (position 578), and 270 degrees (position 582). From FIG. 5, it is apparent that the attachment site 90 and brush head 300 connected thereto also oscillate in a circular fashion. The position of the brush head 300, which is centered about the shaft 200, is shown in outline at each corresponding position during the rotation of the shaft 200. For example, at the rest position 571, the outline of the brush head 300 is shown as 588. At position 572, the corresponding outline of the brush head 300 is shown as 590, while the brush head outline 594 indicates the position of the brush head 300 at the position 576. Similarly, outlines 598 and 502 indicate the positions of the brush head 300 when the shaft 200 is at the positions 578 and 582, respectively.

In FIG. 5, the position of an axis of symmetry 510 of the eccentric weight 60 is shown as passing through the rest position 571 of the eccentric weight 60. This configuration, which corresponds to zero phase displacement of the motor-brush configuration in response to revolution of the eccentric weight 60, is somewhat idealized. In actuality, there is a slight phase lag between the rotation of the eccentric weight 60 and the resulting displacement of the entire assembly. The phase lag, which is not shown, is the result of damping from, for example, frictional forces, and causes the axis of symmetry 510 to slightly trail the center position 571. The degree of phase displacement is not, however, important to the operation of the present invention.

The circular oscillations of the attachment and brush head 300 illustrated above provide the action used for scrubbing. Importantly, while the individual portions of the brush head 300 move in a series of circular oscillations under the influence of the eccentric weight 60, the brush head 300 itself does not rotate about its own axis or about the axis formed by the shaft 200 of the motor 50. Consequently, the angular orientation of each portion of the brush head 300 relative to the handle of the housing 15 remains unchanged throughout the cleaning cycle. Because the rotational motion supplied by the motor-shaft-eccentric combination is transmitted to the brush head 300 by the motor cover 80, the brush head 300 need not be mounted to the motor shaft 200, thereby obviating the need for complex and failure-prone sealing mechanisms. Thus, the flexible gasket 70 can be sealed to the motor cover 80 and the housing 15 using fixed sealing materials such as waterproof epoxy glue, or the like.

Figure 7:
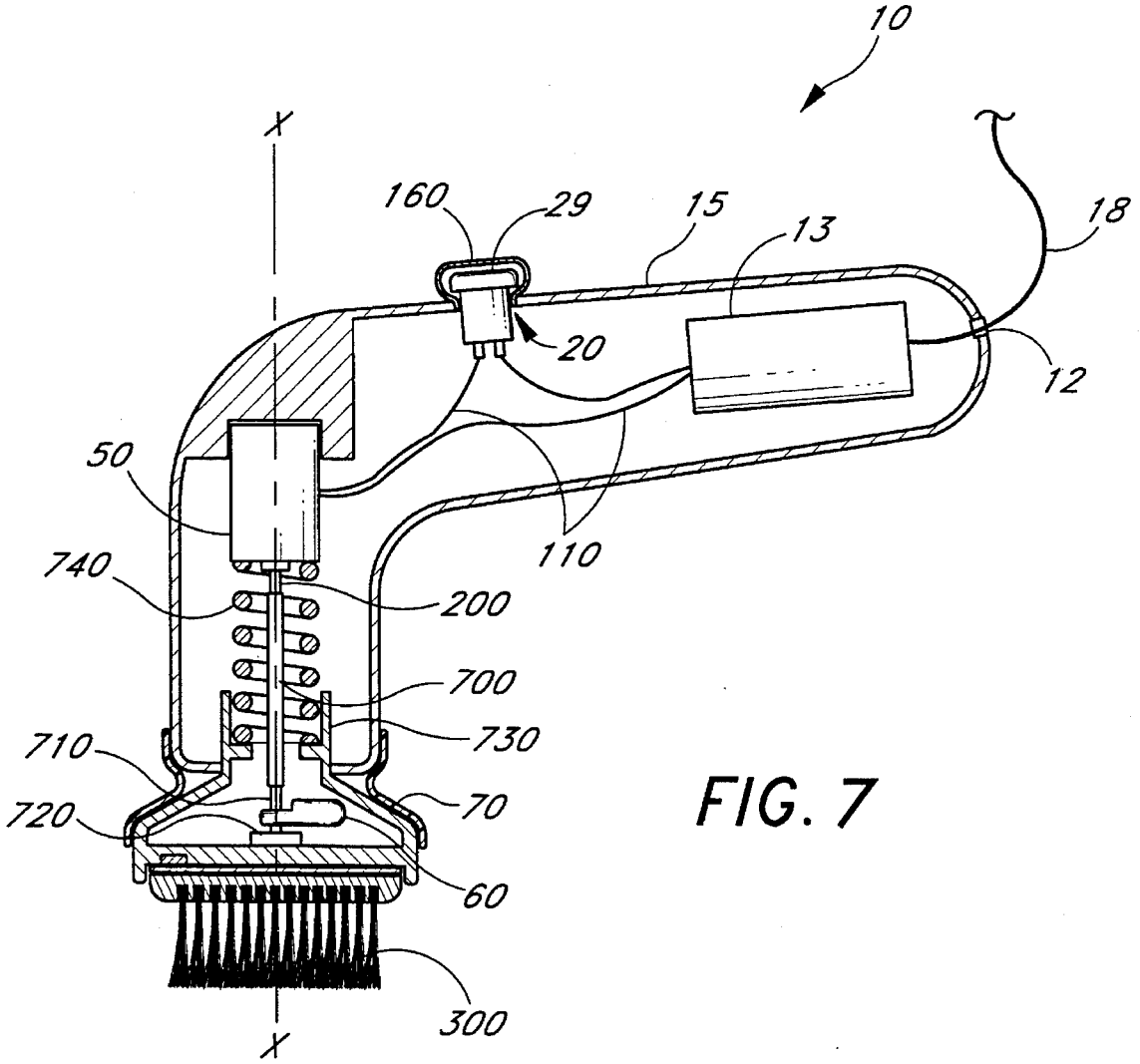
FIG. 7 is a partial side cross-sectional view which shows an alternative embodiment of the brush of the present invention wherein a flexible shaft is coupled between the motor and the eccentric weight.

FIG. 7 is a partial cross-sectional view which depicts an alternate embodiment of the motorized brush 10 of the present invention. In the alternative embodiment of FIG. 7, the motor 50 is attached directly to the housing 15. The shaft 200 of the motor 50 couples with a rotatable flexible shaft 700 which may be constructed from a metal spring or other elastic material. The flexible shaft 700 couples with a rigid bushing shaft 710 having the eccentric weight 60 attached thereto. The rigid bushing shaft 710 rotates within a bushing 720 which may, for example, comprise a self-lubricating bushing or a ball bearing assembly. The bushing 720 is fixedly attached to a cover 730 which is substantially similar in shape and construction to the motor cover 80 of FIGS. 1, 2, 3, and 6. The brush head 300 may, for example, connect to the cover 730 in the same manner that the brush head 300 connects to the cover 80 as described above. The cover 730 connects directly to the motor 50 via a spring 740 which is substantially similar in shape and size to the spring 40 of FIGS. 2 and 6. The spring 740 serves to isolate the motor 50 from the vibrations produced by the oscillating cover 730. Since the motor is rigidly connected to the housing 15, the housing 15 is also isolated from excessive vibration by the spring 740.

The operation of the embodiment of the brush 10 shown in FIG. 7 is substantially similar to the operation of the embodiment of the brush 10 depicted in FIGS. 1–6. However, rather than having the motor 50 oscillate with the brush head 300 as in the embodiment of FIGS. 1–6, the flexible shaft 700 is able to shift off center to accommodate the epicircular motion of the weight 60 and the bushing shaft 710. In this manner, a scrubbing motion similar to that of the embodiment of FIGS. 1–6 is provided so that less vibrational stress is placed upon the motor in the embodiment of FIG. 7.

The embodiments of the present invention therefore provide a reliable, simple and inexpensive motorized cleaning brush with very few moving parts. All of the moving parts are housed in a water-tight compartment which prevents their deterioration and thereby increases the service life of the scrubbing brush of the present invention.

Many modifications of the brush described above will be apparent to those skilled in the art without departing from the spirit and scope of the appended claims.

What is claimed is:

1. A motorized scrubbing appliance, comprising:

a water-tight handle;

an electric motor having proximal and distal ends and a drive shaft mounted on said proximal end;

a spring mounted to the distal end of said motor and to said handle, said spring coupling said motor to said handle to support said motor while vibrationally isolating said handle from said motor;

an eccentric weight mounted to said electric motor drive shaft so as to rotate in an epicircular path with said shaft;

a water-tight cover containing said motor and said eccentric weight; and a scrubbing head attached to said water-tight cover, wherein said motor and said eccentric weight cooperate to vibrate said scrubber without rotating said scrubber when said motor is supplied with electric power.

2. The appliance of claim 1, further comprising a switch mounted within said handle and electrically connected to said electric motor.

3. The appliance of claim 1, wherein said scrubbing head comprises a brush.

4. A motorized scrubber for scrubbing a surface, comprising:

a scrubbing head;

a cover connected to said scrubbing head;

a motor mounted within said cover, said motor having a rotatable shaft extending from a first end of said motor;

an eccentric weight mounted to said shaft of said motor for imparting vibrational motion to said scrubber through said cover when said motor is supplied with electric power;

a water-tight housing coupled to said cover such that said cover and said housing form a water-tight combination; and a spring mounted to a second end of said motor opposite said first end, said spring securing said motor to said housing and vibrationally isolating said motor from said housing.

5. A motorized scrubber as in claim 4, further comprising a switch connected to said electric motor.

6. A motorized scrubber as defined in claim 4, wherein a gasket provides said water-tight combination of said housing and said cover.

7. A motorized scrubber as defined in claim 4, wherein said scrubbing head comprises a brush.

8. A motorized scrubber for scrubbing a surface comprising:

a handle;

a motor attached to said handle, said motor having a rotating motor shaft;

a flexible shaft rotatably coupled to said motor shaft;

an eccentric weight coupled to said flexible shaft so that said flexible shaft imparts rotational motion to said eccentric weight, said eccentric weight being of such a dimension and weight to cause said flexible shaft, together with said eccentric weight to trace an epicircular path;

a housing coupled to said eccentric weight so that said eccentric weight imparts motion to said housing, said housing further coupled to said handle by a water-tight seal; and a scrubbing head attached to said housing.

9. A motorized scrubber as defined in claim 8, further comprising a spring which connects between said motor and said housing.

10. A motorized scrubber as defined in claim 8, further comprising a switch connected to said electric motor.

11. A motorized scrubber as defined in claim 8, wherein said scrubbing head comprises a brush.

12. A motorized scrubber as defined in claim 8, further comprising a spring which couples said housing to said handle.

13. A motorized scrubber, comprising:

a housing including a handle portion;

a motor encased within said housing, said motor including a rotatable shaft;

a cover;

a flexible, watertight seal which couples said cover to said housing;

an eccentric weight encased within said cover, and coupled to said rotatable shaft via a flexible coupling so that said motor causes said eccentric weight to rotate via said rotatable shaft and said flexible coupling;

a scrubbing head coupled to said cover so that said scrubbing head vibrates when said eccentric weight rotates within said cover; and a vibrational isolator coupled between said motor and said cover to dampen vibrations imparted to said motor and said handle when said eccentric weight rotates.

* * * * *